US005881467A

United States Patent [19]

Clara et al.

[11] Patent Number: 5,881,467

[45] Date of Patent: Mar. 16, 1999

[54] METHOD OF READING OFF THE CROSS-SECTION OF THE BEZEL OF AN EYEGLASS FRAME, CORRESPONDING FEELER, AND APPLICATION OF THIS METHOD TO TRIMMING THE LENS TO BE FITTED

[75] Inventors: Philippe Clara, Le Perreux; Pascal Daboudet, Bouffemont; Ahmed Haddadi, Draveil, all of France

[73] Assignee: Essilor International Compagnie Generale d'Optique, Charenton Le Pont, France

[21] Appl. No.: 888,095

[22] Filed: Jul. 3, 1997

[30] Foreign Application Priority Data

Jul. 18, 1996 [FR] France ..... 96 09016

[51] Int. Cl.[6] ..... G01B 21/04

[52] U.S. Cl. ..... 33/200

[58] Field of Search ..... 33/1 M, 28, 200, 33/534, 507, 542, 546, 549, 551, 553, 554, 556

[56] References Cited

U.S. PATENT DOCUMENTS

| | | | |
|---|---|---|---|
| 5,121,548 | 6/1992 | Daboudet et al. | 33/507 |
| 5,121,550 | 6/1992 | Wood et al. | 33/200 |
| 5,189,806 | 3/1993 | McMurtry et al. | 33/553 |
| 5,276,974 | 1/1994 | Chanoni et al. | 33/546 |
| 5,307,150 | 4/1994 | Lecerf et al. | 33/200 |
| 5,351,411 | 10/1994 | Gronskov | 33/551 |

FOREIGN PATENT DOCUMENTS

| | | | |
|---|---|---|---|
| 0 190 450 | 8/1986 | European Pat. Off. . | |
| 0 424 207 | 4/1991 | European Pat. Off. . | |
| 0 502 785 | 9/1992 | European Pat. Off. . | |
| 0 583 915 | 2/1994 | European Pat. Off. . | |
| 0 606 171 | 7/1994 | European Pat. Off. . | |
| 2 634 880 | 2/1990 | France . | |
| 2 679 997 | 2/1993 | France . | |
| 196407 | 11/1983 | Japan | 33/507 |

*Primary Examiner*—G. Bradley Bennett
*Attorney, Agent, or Firm*—Young & Thompson

[57] ABSTRACT

In a method of reading off the cross-section of the bezel of an eyeglass frame rim or surround at one point at least on the latter, a mobile feeler the position of which can be defined in a given system of coordinates is moved into line with the bezel. The head of the feeler successively sights at least two different points of at least one of the flanks of the bezel in order to deduce the coordinates of these points. The cross-section of the bezel read off in this way is used in trimming the lens to be mounted in the bezel.

13 Claims, 2 Drawing Sheets

METHOD OF READING OFF THE CROSS-SECTION OF THE BEZEL OF AN EYEGLASS FRAME, CORRESPONDING FEELER, AND APPLICATION OF THIS METHOD TO TRIMMING THE LENS TO BE FITTED

BACKGROUND OF THE INVENTION

1. Field of the Invention

The present invention is generally concerned with reading off the contour of the rims or surrounds of an eyeglass frame as usually carried out in order to match to the latter the eyeglass lenses to be mounted therein.

The contour is usually read off by means of a device equipped with an appropriate sensor or feeler.

2. Description of the Prior Art

A contour reading device of this kind is described in U.S. Pat. No. 5,121,548, for example.

In the above patent the eyeglass frame from which the contour is to be read off is held fixed and the feeler includes a head to be inserted into the bezel of the rim or surround concerned at the end of a rod. This head is mobile and its position is systematically defined in a particular system of coordinates.

This example uses polar coordinates in a plane perpendicular to the rod of the feeler plus an altitude in the direction perpendicular to this plane to allow for the menisci of the more usual eyeglass frame rims or surrounds.

At present, as in the patent mentioned above, contour reading is essentially concerned with the circumferential contour of the rim or surround of the eyeglass frame being measured.

However, no account is taken of the actual profile of the bezel of this rim or surround, i.e. the cross-section of the bezel.

This cross-section can be dihedral or of any other kind, for example half-round; moreover, there is in practise a great diversity of bezel cross-sections from one eyeglass frame to another, depending on the manufacturer.

Given the inevitable manufacturing tolerances of the grinding wheels used to cut the corresponding bead on the edge of an eyeglass lens, which is traditionally called a bevel even when its cross-section is not dihedral, and the wear to which such grinding wheels are inevitably subject in time, it is by no means rare to observe discrepancies between the cross-section of the bevel of an eyeglass lens and that of the bezel of the eyeglass frame rim or surround in which the latter is to be mounted that are sufficiently great to compromise the proper retention of the eyeglass lens in the rims or surrounds of the eyeglass frame.

When cutting a bevel on the edge of an eyeglass lens it is therefore desirable to make the maximum allowance for the actual cross-section of the bezel of the eyeglass frame rim or surround in which the eyeglass lens is to be mounted.

In U.S. Pat. No. 5,450,335 it is assumed that the angle of the cross-section, which is dihedral in this example, is known.

The present invention consists in a method for effectively reading of this cross-section; the invention also consists in a feeler for implementing this method.

SUMMARY OF THE INVENTION

The present invention consists in a method of reading off the cross-section of a bezel of an eyeglass frame rim or surround at one point at least on the latter, wherein a mobile feeler the position of which can be defined in a given system of coordinates is moved into line with said bezel, a head of said feeler successively sighting at least two different points of at least one flank of said bezel in order to deduce therefrom the coordinates of said points. As the bezel can have any cross-section, by "flank" here is meant each of the walls of the bezel on respective opposite axial sides of the back proper of the bezel.

If the cross-section of the bezel is dihedral, it can be sufficient to sight two points on one flank with the head of the feeler and to deduce the slope of this flank from the coordinates of these two points.

If, in the conventional way, the feeler to be used has an intangible head for "sighting" the bezel, i.e. a head of particular geometry, one of the flanks of the bezel is sighted in isolation, without interference with the other flank, and either this reading is extrapolated by symmetry for the other flank or the other flank is then sighted in the same manner as the first.

Alternatively, if the feeler to be used has an interchangeable head for sighting the bezel, both flanks of the bezel are sighted simultaneously with a first head and then with a second head of a different caliber than the first.

In all cases, regardless of the shape of the cross-section of the bezel, and in addition to the usual reading off of the circumferential contour of the rims or surrounds of the eyeglass frame being measured, the reading carried out in accordance with the invention provides a very simple way of determining the cross-section of the bezel of the rims or surrounds of the eyeglass frame, at one point of the latter at least.

The invention also consists in the application of the above method to trimming the lens to be mounted in said bezel whose cross-section has been read off. It is then possible to reconstitute completely the nesting of the lens in the eyeglass frame and thus to determine the position of the points of contact between the bevel of the lens and the flanks of the bezel of the frame and of the apex of the bezel.

To be more precise, the nesting of the lens is reconstituted by graphically and/or numerically converging the cross-section of the bezel and that of the grinding wheel to be used to trim the lens, these two cross-sections being to the same scale, of course; the cross-section of the grinding wheel is obtained by conventional means, such as a profile projector, dimensional machine or other device. The position in which the cross-section of the grinding wheel touches the cross-section of the bezel corresponds to the simulated fitting of the lens into the frame, which gives the position of the apex of the bevel relative to the bezel; the instructions to be given to the grinding wheel to trim the lens are then obtained by correcting the reading relating to the circumferential contour of the bezel allowing for this relative position of the apex of the bevel.

The features and advantages of the invention will emerge from the following description given by way of example with reference through the accompanying diagrammatic drawings.

DETAILED DESCRIPTION OF THE PREFERRED EMBODIMENTS

Figure 1:
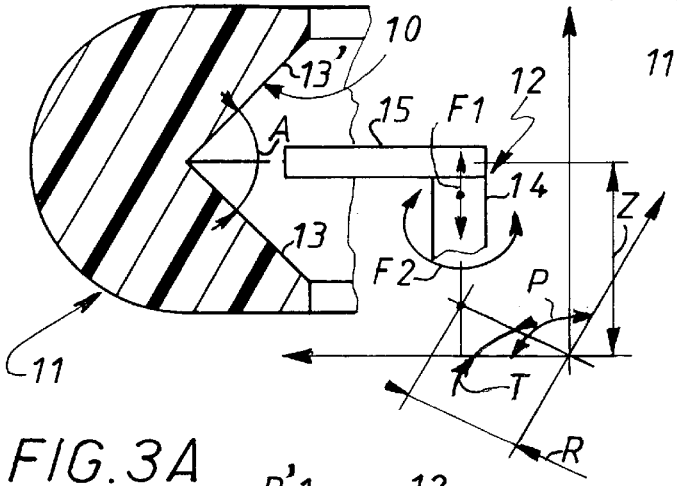
FIG. 1 is a cross-sectional view of an eyeglass frame rim or surround showing in elevation, and facing the latter, a feeler adapted to come into contact with it.

FIG. 1 shows the cross-section of the bezel 10 of a rim or surround 11 of an eyeglass frame that cannot be seen in its entirety, this cross-section being at any point on the rim or surround 11, and in elevation the end part of a feeler 12 which is part of a contour reading device of any kind, also not shown.

For convenience, in the remainder of the description a contact type feeler is used to define points on the bezel being measured, so that it is necessary to "apply" the head of the feeler to said points; these points can obviously be defined using a contactless feeler, for example of the optical head type.

In a manner known in itself, the bezel 10 whose cross-section is to be read off forms a groove along the inside periphery of the rim or surround 11.

In the embodiment shown it has a dihedral cross-section with two oblique flanks 13 and 13' which intersect at their inside end at an angle A.

The feeler 12 includes a rod 14 substantially perpendicular to the plane of the rim or surround 11 and a head 15 projecting cantilever fashion from the rod 14, in practise from the top of the latter, and adapted to be engaged in the bezel 10 in order to come into contact with the latter.

In the embodiment shown in FIG. 1, the head 15 is intangible in that it is fixed permanently to the rod 14 and has a particular geometry and therefore a particular caliber.

As shown here, for example, it is a flat plate perpendicular to the rod 14 and pointed like a stylus.

In the contour reading device employed, the eyeglass frame of which the rim or surround 11 is part is fixed in position, for example clamped between jaws for holding it, and the feeler 12 is mobile.

To this end, it is coupled by its rod 14 to a drive mechanism forming part of the contour reading device.

The corresponding provisions are well known in themselves, in particular from U.S. Pat. No. 5,121,548 previously referred to, and as they are not themselves relevant to the present invention they will not be described in more detail here.

Suffice to say that, in this contour reading device, the position of the feeler 12 is defined in a given system of coordinates.

As shown diagrammatically in FIG. 1, for example, the feeler 12 is mobile in a plane P substantially parallel to the plane of the eyeglass frame of which the rim or surround 11 is part. It is also mobile perpendicularly to this plane P, along the axis of its rod 14, as shown diagrammatically by a double-headed arrow F1 in FIG. 1.

The position of the feeler 12 in the plane P is defined in polar coordinates RT, for example, as in the contour reading device that is the subject matter of U.S. Pat. No. 5,121,548.

Perpendicularly to the plane P the position of the feeler 12 is defined by its altitude Z.

As show diagrammatically by a double-headed arrow F2 in FIG. 1, the feeler 12 can also be mounted to rotate about the axis of its rod 14, for controlling the orientation of its head 15.

In accordance with the invention, to read off the cross-section of the bezel 10 the feeler 12 is moved towards the back of the bezel 10 by successively applying the head 15 of the feeler 12 to two different points P1, P2, P'1, P'2 of at least one flank 13, 13' of the bezel 10 and the slope of the flank 13, 13' is deduced from the coordinates of these points P1, P2, P'1, P'2.

If, as shown in FIG. 1, the feeler 12 to be used has an intangible head 15 for contact with the bezel 10, one of the flanks 13, 13' of the bezel 10 is sighted in isolation, without interfering with the other flank.

Figure 2A:
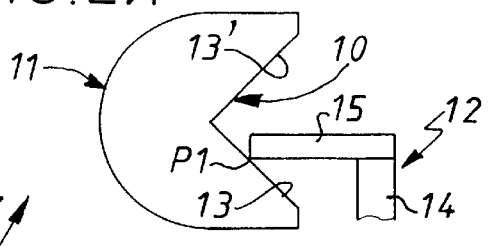
FIGS. 2A and 2B are views derived from that of FIG. 1 and showing two successive phases of implementation of the method of the invention for reading off the slope of one of the flanks of this bezel.
Figure 2B:
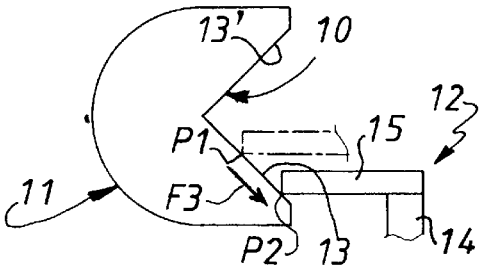

As shown diagrammatically in FIGS. 2A and 2B, for example, the head 15 of the feeler 12 is first moved into contact with the flank 13 at a point P1 of the flank 13 relatively near the back of the bezel 10 (FIG. 2A) and then, maintaining the head 15 of the feeler 12 in contact with the flank 13, it is slid in contact with the flank 13 to a point P2 on the latter relatively near the mouth of the bezel 10, as shown diagrammatically by the arrow F3 in FIG. 2B.

An elementary calculation using the coordinates of the points P1, P2 read off in this way gives the slope of the flank 13.

To a first approximation, the slope measured in this way for the flank 13 can be extrapolated by symmetry to the flank 13'.

Figure 3A:
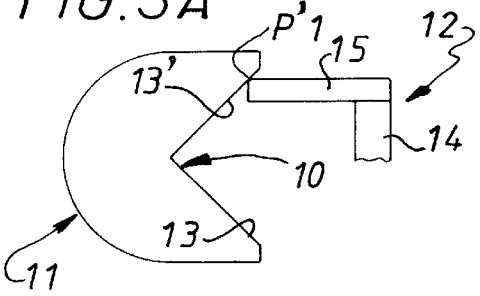
FIGS. 3A and 3B are views similar to that of FIGS. 2A and 2B for reading off the slope of the other flank of the bezel concerned.
Figure 3B:
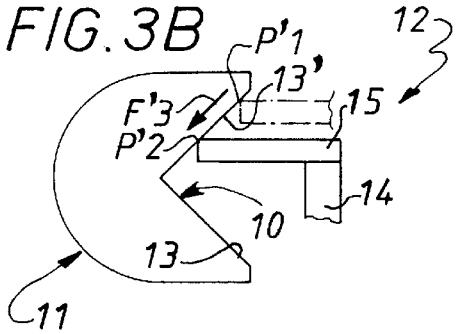

However, it is also possible to sight the flank 13' by the same method, as shown in FIGS. 3A and 3B, if required.

As shown here, for example, the head 15 of the feeler 12 is first applied to the flank 13' at a point P'1 on the latter relatively near the mouth of the bezel 10 (FIG. 3A) after which, maintaining the head 15 of the feeler 12 in contact with the flank 13', it is slid along the flank 13' to a point P'2 on the latter relatively near the back of the bezel 10, as shown diagrammatically by the arrow F'3 in FIG. 3B.

Figure 4:
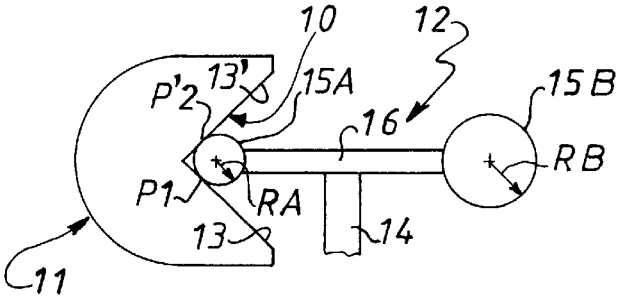
FIGS. 4 and 5 are views similar to those of FIGS. 2A, 2B, 3A, 3B for simultaneously sighting both flanks of the bezel using a feeler in accordance with the invention.
Figure 5:
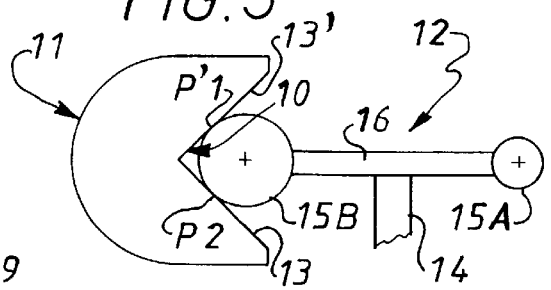
Figure 6:
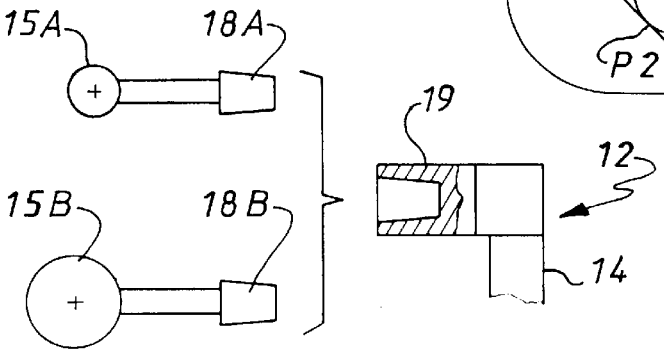
FIG. 6 is a locally cut away exploded view of a variant embodiment of this feeler.

FIGS. 4 through 6 show a variant embodiment of the invention using a feeler 12 having an interchangeable head 15A, 15B for contact with the bezel 10.

The feeler 12 can therefore have at least two heads 15A, 15B of different calibers associated with the same rod 14.

In the embodiment shown in FIGS. 4 and 5 the two heads 15A, 15B are permanently fixed to respective opposite ends of a crossbeam 16 carried by the rod 14, at its upper end, for example, as shown here, and extending either side of the rod 14, substantially perpendicular to it.

In this embodiment, the two heads 15A, 15B are spherical heads with different radii RA, RB.

With an interchangeable head 15A, 15B of this kind it is advantageously possible to sight both flanks 13, 13' of the bezel 10 simultaneously.

For example, initially (FIG. 4) the two flanks 13, 13' of the bezel 10 are sighted simultaneously with a first head 15A to read off the coordinates of a point P1 on the flank 13 of the bezel 10 and the coordinates of a point P'2 on the flank 13' of the latter and, after the feeler 12 is turned around, the process is repeated with the second head 15B, which has a different caliber than the first, to read off the coordinates of a point P2 of the flank 13 of the bezel 10 and the coordinates of a point P'1 of the flank 13' of the latter.

In the embodiment shown in FIG. 6, each of the heads 15A, 15B is carried by an individual coupling 18A, 18B by means of which it can be removably attached to the rod 14.

As shown here, for example, the coupling 18A, 18B is of the same type for both heads 15A, 15B and constitutes a coupling 18A, 18B adapted to cooperate sleeving fashion with a complementary coupling 19 provided for this purpose on the rod 14.

In the embodiment shown, the coupling 18A, 18B of the rods 15A, 15B is a male coupling and the coupling 19 on the rod 14 is a female coupling, but the opposite arrangement can obviously be adopted.

In the examples that have just been described the cross-section of the bezel 10 is dihedral in shape; it will be understood that the invention applies regardless of the shape of the cross-section of the bezel; if the latter is not dihedral in shape, the coordinates of a plurality of points, for example about 100 points, are need to obtained a good representation of said cross-section.

An application of the method of the invention to the trimming of lenses will now be described.

Figure 7:
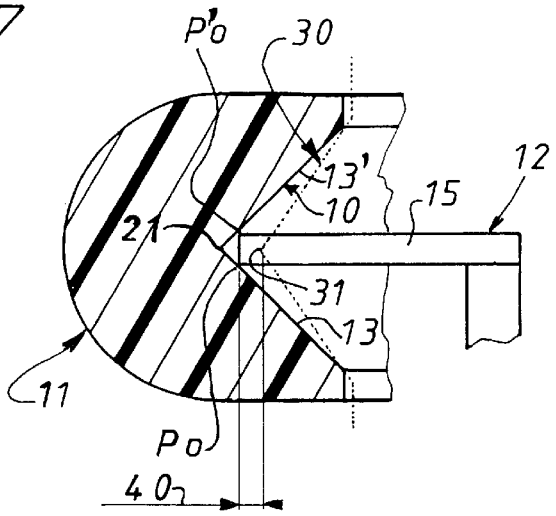
FIGS. 7 and 8 show schematically the application of the method to the trimming of a lens, the feeler being of the type from FIGS. 1 through 3B.
Figure 8:
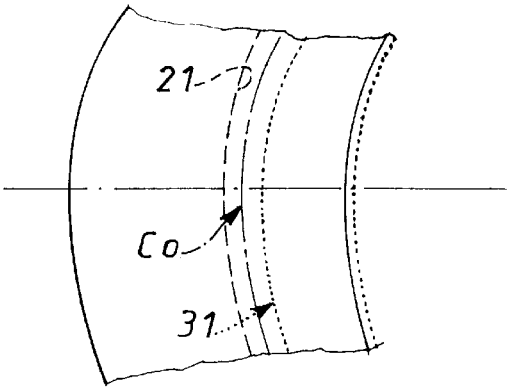

FIGS. 7 and 8 show an application of the method in which the feeler is of the type described with reference to FIGS. 1 through 3B.

FIG. 7 shows the bezel 10 of the rim or surround 11 whose cross-section, here the dihedral flanks 13, 13', has been determined by the above method using the feeler 12; the latter is at the back of the bezel, its head 15 touching the flanks 13, 13' at Po, P'o, respectively, and at a distance from the back 21 proper, i.e. the line of intersection of the flanks 13, 13' of the bezel 10; it is in this position that the feeler 12 is moved parallel to the plane P to read off the circumferential contour of the frame rim or surround, in fact a geometrically similar image Co of the back 21 of the bezel 10, seen partly in plan view in FIG. 8, which is a top view relative to FIG. 7, said image Co being produced from the readings of the feeler, in this instance the coordinates of the points of contact of the feeler 12 with the flanks 13, 13' of the bezel 10.

FIG. 7 also shows the cross-section 30 of the grinding wheel for trimming the lens to be associated with the bezel 10, this cross-section 30 being to the same scale to that of the bezel 10. The two cross-sections are moved towards each other until they are in contact to simulate the mounting of the lens in the bezel 10, the cross-section of the grinding wheel being naturally strictly complementary in shape to that of the bevel on the lens.

The apex 31 of the cross-section 30, which in fact represents the bottom of the groove in the grinding wheel and the bevel on the trimmed lens, is at a distance 40 from Co. It is sufficient to allow for this distance or offset to define the contour 31 to be imparted to the lens to mount it correctly in the bezel 10, this contour 31 giving the perimeter of the lens (FIG. 8).

This offset could of course also be corrected by a functional clearance, if required, for example to limit or to eliminate stresses on fitting the lens, especially if the latter is a mineral glass lens.

Figure 9:
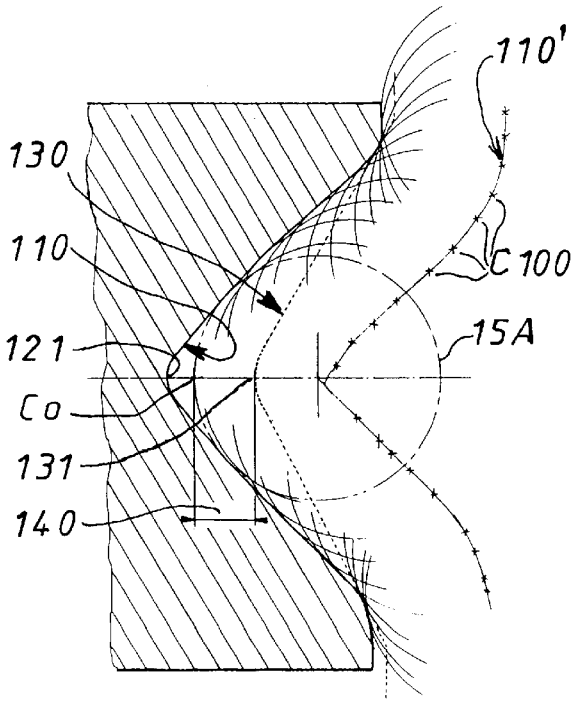
FIG. 9 is a diagram similar to that of FIG. 7, the feeler being of the type from FIGS. 4 and 5 or 6.

FIG. 9 shows an application similar to the one just described, but for the situation in which the feeler is of the spherical head type, for example the feeler 15A of FIGS. 4 through 6. Here the data from the feeler gives the curve 110', the locus of points C100 corresponding to each position of the center of a sphere 15A as the feeler is moved along the bezel, the flanks of which are therefore the envelope of the circular cross-sections of said sphere.

As previously, moving the cross-section 110 of the bezel and that 130 of the grinding wheel towards each other gives the offset 140 between the image Co, which is here that of the point on the feeler nearest the back 121 of the bezel, and the apex 131 of the bevel on the trimmed lens.

The present invention is not limited to the embodiments described and shown, but encompasses any variant execution thereof.

There is claimed:

1. A method of reading off the cross-section of a bezel of an eyeglass frame rim or surround, wherein a mobile feeler is moved into line with said bezel, a head of said feeler successively sighting at least two different points of at least a first flank of said bezel in order to deduce therefrom the coordinates of said points.

2. The method claimed in claim 1 wherein said feeler has an intangible head for sighting said bezel and said first flank of said bezel is sighted in isolation without interfering with a second flank.

3. The method claimed in claim 2 wherein said second flank of said bezel is then sighted.

4. The method claimed in claim 1 wherein said cross-section of said bezel is dihedral in shape and said head of said feeler sights two different points on at least said first flank of said bezel in succession and a slope of said flank is deduced from coordinates of said points.

5. The method claimed in claim 2 wherein said feeler is a contact type feeler and said head of said feeler is slid along said first flank of said bezel when in contact with said bezel.

6. The method claimed in claim 1 wherein said feeler is a contact type feeler having an interchangeable head for contact with said bezel and said first and second flanks of said bezel are sighted simultaneously with a first head of said feeler and then with a second head of said feeler having a different caliber than said first head.

7. A feeler for implementing a method as claimed in claim 6 including at least two heads of different calibers associated with a common rod.

8. The feeler claimed in claim 7 wherein said two heads are permanently fixed to respective opposite ends of a crossbeam carried by said rod.

9. The feeler claimed in claim 7 wherein each head is carried by an individual coupling by means of which it is adapted to be removably attached to said rod.

10. The feeler claimed in claim 9 wherein said coupling on each of said two heads is of the same type and is adapted to cooperate sleeving fashion with a complementary coupling provided for this purpose on said rod.

11. The feeler claimed in claim 7 wherein said two heads are spherical heads with different radii.

12. An application of the method as claimed in claim 1 wherein said cross-section of said bezel and a cross-section of a grinding wheel for trimming a lens that said bezel is to receive are moved towards each other until fitting of said lens into said bezel is simulated and instructions to be given to said grinding wheel to trim said lens are deduced accordingly.

13. The application claimed in claim 12 wherein said instructions are based on a measured coupling between an image of the circumferential contour of the back of said bezel and an image of the apex of the bevel of said lens represented by the bottom of the groove of said grinding wheel.

* * * * *